United States Patent [19]

Ross

[11] Patent Number: 4,804,347

[45] Date of Patent: Feb. 14, 1989

[54] SURFBOARD FIN MOUNT

[76] Inventor: Melvin C. Ross, 34822 Camino Capistrano, Capistrano Beach, Calif. 92624

[21] Appl. No.: 7,955

[22] Filed: Jan. 28, 1987

[51] Int. Cl.[4] ..... A63C 15/05

[52] U.S. Cl. ..... 441/79; 156/293; 156/267; 114/357

[58] Field of Search ..... 114/140, 357; 441/74, 441/79; 156/293, 267

[56] References Cited

U.S. PATENT DOCUMENTS

| | | | |
|---|---|---|---|
| 3,287,754 | 11/1966 | Price et al. | 441/74 |
| 3,956,549 | 5/1976 | Stoeberl | 156/267 |
| 3,965,514 | 6/1976 | Shafer et al. | 441/79 |
| 4,379,703 | 4/1983 | Mizell | 441/79 |

FOREIGN PATENT DOCUMENTS

| | | | |
|---|---|---|---|
| 2539377 | 7/1984 | France | 441/74 |

*Primary Examiner*—Joseph F. Peters, Jr.
*Assistant Examiner*—Edwin L. Swinehart
*Attorney, Agent, or Firm*—Roy A. Ekstrand

[57] ABSTRACT

A structure for mounting fins to the under side of a surfboard includes an elongated molded fin socket member which defines an interior rectangular slot configured to receive a rectangular base of a fin member. The fin socket further defines an upwardly extending cover recess coextensive with the slot. The fin socket is adhesively secured within a contoured recess within the surfboard foam core prior to the laminating operation. After the surfboard has been laminated with the fin socket in place such that the laminating materials overlap the fin socket, the upwardly extending portion of the fin socket is removed and ground flush to the laminated surface of the surfboard to expose the rectangular slot. Thereafter, the fin is adhesively secured within the slot.

10 Claims, 2 Drawing Sheets

SURFBOARD FIN MOUNT

FIELD OF THE INVENTION

This invention relates generally to surfboard construction and particularly to the attachment of fin members to surfboards constructed of a foam core.

BACKGROUND OF THE INVENTION

The popularity of surfing as a sports and recreation activity has prompted surfboard fabricators to create several surfboard designs and to develop various methods of surfboard construction. While the particulars of surfboard construction are varied to some extent and ar generally a matter of design choice, all surfboards generally comprise a substantially planar, elongated buoyant board having a generally pointed front portion and a tapered rear portion. In most constructions the surfboard edges are rounded to achieve optimum fluid motion characteristics. In recent years, the surfboard constructions have generally been divided on the basis of surfboard lengths. The so called long boards are typically seven or eight feet in length while the newer short boards are approximately five feet in length. The emergence of short boards results in increased maneuverability on the part of the user and is achievable primarily due to the exceedingly buoyant yet strong construction afforded by the recently developed foam core type surfboards.

Unlike the long board construction in which the board is formed of a solid wood construction, the short boards comprise a light weight plastic foam material shaped to conform to the desired surfboard configuration. To achieve the required strength, the surfboard is "glassed" by covering the foam core with multiple layers of fiberglass cloth laminated with a laminating resin to produce a smooth, durable outer finish. The laminated fiberglass provides a waterproof seal for the foam core and substantially increases the strength and weight supporting ability of the surfboard.

To provide the desired characteristics of the surfboard, a plurality of downwardly extending fins, generally three, are attached to the rear underside of the surfboard.

In the typical foam core surfboard construction, the foam core is initially formed and shaped to the desired surfboard configuration. Thereafter, a layer of fiberglass cloth is fitted to the surfboard's bottom surface and a laminating resin is applied in sufficient quantity to saturate the entire fiberglass cloth and underlying foam surface. The excess resin and any accumulated air bubbles are removed by a squeegee process. The fiberglass cloth is then wrapped around the edge portions of the surfboard foam core and a second layer of fiberglass cloth is laminated to the other surface of the surfboard in a similar process. Once the resin has cured, the process of fin installation is carried forward.

A plurality of hand made fiberglass fins are positioned on the underside of the surfboard and glued in place with a suitable resin mixture. After the initial fin glue has cured, fiberglass cloth patches are layered along the junction of the surfboard surface and the sides of the attached fins. The fiberglass cloth is then saturated with resin and smoothed to remove bubbles and excess resin. As a result, a fillet contoured to the junction of the surfboard and fin is produced which strengthens the attachment of the surfboard. The next step is to remove the excess fiberglass from the fins and the adjacent portions of the surfboard and allow the resin to cure. Next, a coat of sanding resin is applied to the surfaces of the surfboard and allowed to cure completely. Thereafter, the surfboard is sanded by progressively finer grit sanding materials to produce a clean, smooth surface. It has been determined that approximately one-third of the entire sanding time required for a surfboard is spent addressing the fin area and surrounding board surfaces. Once sanding is complete, a finished coat of resin is applied and cured to produce a high-gloss resin finish. As a final step, the finish resin is sanded with progressively finer sand grits and eventually buffed to a high lustre. The problems of properly sanding and polishing the fin area continue to occupy a major portion of the time expended on the sanding process.

In addition to the inordinate sanding time required to fabricate the conventional finned surfboard, a safety hazard is presented in that the fins tend to cut the finishers hand when it slips during the sanding operation. In addition, the fins often interfere with and grab the buffing wheel used in the final buffing process. These problems associated with the foregoing manufacture of finned surfboards have prompted practitioners in the surfboard fabricating art to create structures which permit the fins to be secured to attachments within the surfboard by various clamp and fastener constructions. One such structure is set forth in U.S. Pat. No. 3,564,632. To date however, such fin holders have been subject to disadvantages of increased weight and have exhibited poor mounting strength and are not therefore, found generally acceptable by surfboard manufacturers.

There arises therefore, a need in the art for a simpler and more economical method of surfboard fabrication which overcomes the difficulties of attaching and securing the fins to the underside of foam core surfboards.

SUMMARY OF THE INVENTION

Accordingly, it is a general object of the present invention to provide an improved surfboard construction. It is a more particular object of the present invention to provide a system for easily and economically fabricating a surfboard which supports a plurality of fin members. It is a still more particular object of the present invention to provide an improved surfboard construction in which the fins are easily and quickly attachable to the surfboard in a strong and secure attachment.

In accordance with the present invention, there is provided a surfboard fin mount in which a generally elongated tapered socket is received within a corresponding elongated tapered cavity within the foam core of a surfboard. The socket defines a extended portion surrounding a central elongated slot which is capped by a corresponding elongated cover portion. The socket is secured within the contoured recess such that the cover portion extends above the adjacent foam surface. A plurality of fiberglass laminations are placed upon the foam core and overlap the extending portions of the fin socket in continuous laminations. Thereafter, the portion of the slot covering member extending above the laminations is removed flush with the laminated surface of the surfboard and a generally planar fin defining a fin base configured to fit securely and precisely within the elongated slot is placed within the slot and secured therein with an adhesive material.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
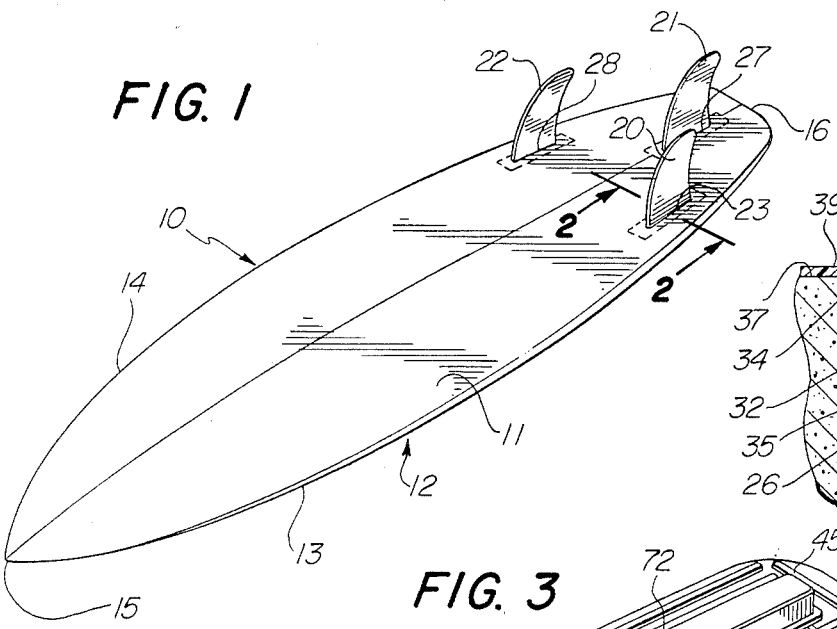
FIG. 1 is a perspective view of the under side of a surfboard constructed in accordance with the present invention.

FIG. 1 sets forth a perspective view of a surfboard constructed in accordance with the present invention generally referenced by reference numeral 10 and defining a bottom surface 11 and a upper surface 12 (not seen in FIG. 1). Surfboard 10 further defines edges 13 and 14 which generally curve inwardly in the front portion of surfboard 10 to form a point 15 and which generally curve inwardly to form a rear portion 16. In accordance with the invention, a trio of fins 20, 21 and 22 extend generally upwardly from bottom surface 11. The outer surfaces of fins 20, 21 and 22 are joined to bottom surface 11 at junctions 23, 27 and 28 respectively in accordance with the present invention fin mounting system. The structure of the present invention fin mounting system is set forth below in greater detail. However, suffice it to note here that fins 20 21 and 22 are secured to surfboard 10 in a generally clean manner such that bottom surface 11 is substantially even and undisturbed in the regions thereof adjacent to junctions 23, 27 and 28.

Figure 2:
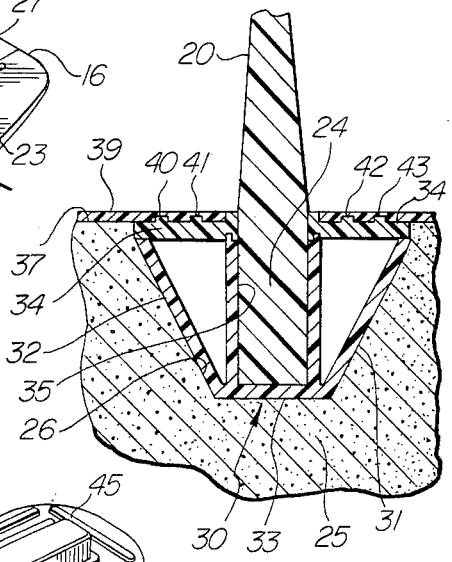
FIG. 2 is a section view of a portion of the surfboard of FIG. 1 taken along section lines 2—2 in FIG. 1.

FIG. 2 sets forth a partial section view of the mounting socket of fin 20 taken along section lines 2—2 in FIG. 1. A foam core 25 formed of conventional surfboard foam core material defines a generally trapezoidal contoured recess 26 (the details of which are better seen in FIG. 8). Contoured recess 26 receives a fin socket 80 having a bottom surface 33 and a pair of tapered side surfaces 31 and 32 which generally conform to contoured recess 26. Fin socket 30 further defines an upper flange 34 extending inwardly from sides 31 and 32 to junction 23. Fin socket 30 further defines an upwardly extending slot 35 which is closed at one end by bottom surface 33 and is joined at its upper end to flange 34 in a structure set forth below in greater detail. Flange 34 further defines a plurality of upwardly extending rib portions 40, 41, 42 and 48. A resin lamination 39 constructed in accordance with conventional resin lamination techniques, extends across the upper surface 87 of foam core 25 as well as the upper surface of flange 34. In accordance with an important aspect of the present invention, resin lamination 39 is bonded to surface 37 of foam core 25 and the upper surface of flange 34. In accordance with a further advantage of the present invention, resin lamination 39 captivates and is bonded to ribs 40 through 43.

Fin 20 defines a generally rectangular fin base 2 configured to be snugly received within fin slot 35. Fin socket 30 is bonded to and within contoured recess 26 by an adhesive layer (not shown). Similarly, fin base 24 is bonded within fin slot 35 by an adhesive layer (not shown). While the type of adhesive selected to secure fin socket 80 within contoured recess 26 and fin base 24 within fin slot 35 is to some extent a matter of fabricator's choice, it has been found advantageous to use an epoxy resin adhesive.

Figure 3:
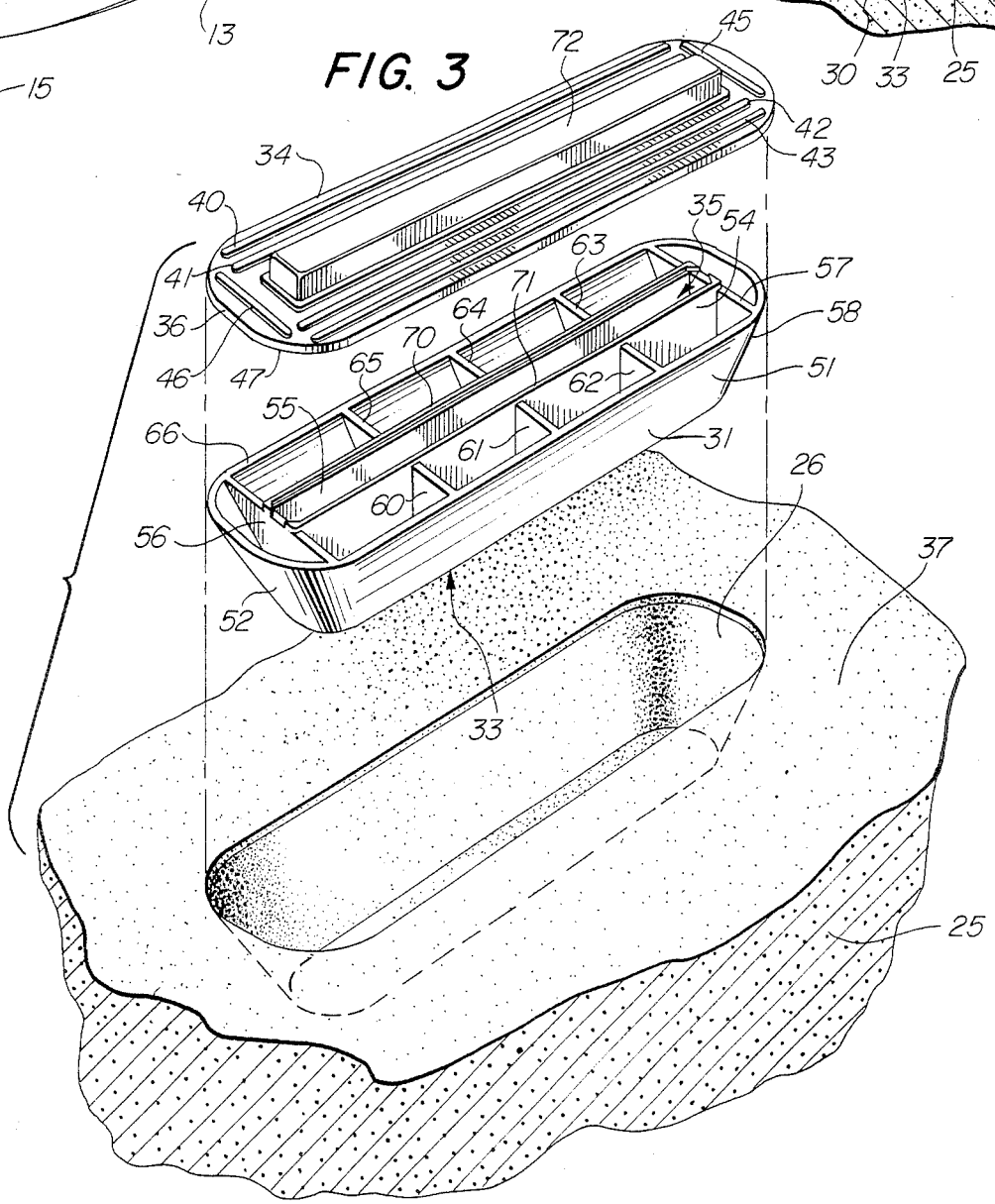
FIG. 3 is an exploded perspective view of the present invention fin socket and the contoured recess within the surfboard foam core receiving it.

FIG. 3 sets forth a perspective exploded view of fin socket 30 being assembled to foam core 25 in accordance with the present invention. Fin socket 30 includes a socket base 51 and a socket cover plate 86. Socket base 51 comprises a tapered trough-like structure having generally straight tapered sides 31 and 32 (the latter seen in FIG. 2) and generally curved conical end portions 52 and 58. A bottom surface 88 completes the tapered trough-like enclosure formed of sides 31 and 32 and curved tapered ends 52 and 58. Sides 31 and 32 and ends 52 and 58 terminate on their upper portions in a common continuous top edge 66. Top edge 66 defines a substantially flat continuous edge. A pair of end plates 56 and 57, having a generally planar configuration, extend across the interior portions of sides 31 and 32 at the respective junctions of sides 31 and 32 with ends 52 and 58. A pair of generally planar slot walls 54 and 55 extend between and are joined to end plates 56 and 57 in a parallel arrangement to form a fin slot 35. The combination of end plates 56 and 57 and slot walls 54 and 55 form a generally rectangular shaped fin slot 36. Slot wall 54 terminates at its upper edge in a upwardly extending ridge 71 while slot wall 55 terminates in its upper edge in a ridge 70. The function of ridges 70 and 71 is set forth below in greater detail. However, suffice it to state here, that ridges 70 and 71 cooperate with portions of socket cover plate 86 (seen better in FIGS. 5 through 7) to produce a continuous fin slot 35 to receive fin base 24.

Socket base 51 further includes a plurality of substantially planar rib members 60, 61 and 62 extending between and joined to slot wall 54 and side 31. Similarly, socket base 51 defines a plurality of substantially planar ribs 63, 64 and 65 extending between and joined to slot wall 55 and side 82. Ribs 60 through 65 provide additional strengthening and support for slot walls 54 and 55 to strengthen the mounting of fin 20 within slot 35.

Socket cover plate 36 comprises a generally flat flange 34 configured to correspond to top edge 66 and defining a plurality of elongated straight ribs 40, 41, 42 and 43 extending in a parallel configuration for a substantial portion of the length of slot cover 36. Flange 34 further defines a pair of shorter ribs 45 and 46 positioned generally orthogonal to ribs 40 through 43. Socket cover plate 36 further defines a generally elongated rectangular upwardly extending slot cover 72 which, in accordance with an important aspect of the present invention set forth below in greater detail, corresponds to the dimensions of fin slot 35.

In accordance with the invention, socket base 51 and socket cover plate 36 are initially assembled together by an adhesive layer placed along top edge 66, ridges 70 and 71 as well as the upper edges of end plates 56 and 57 and ribs 60 through 65. As is better seen in FIGS. 5 through 7, socket cover plate 36 defines a generally planar under surface 47 which is secured to the upper edges of end plates 56 and 57, ribs 60 through 65 and top edge 66 by the foregoing described adhesive process. As is also better seen in FIG. 5, socket cover plate 86 defines a upwardly extending rectangular recess 78 which terminates in a closed slot cover 72. As is also seen best in FIG. 5, recess 73 defines a pair of downwardly extending ribs 74 and 75. In accordance with an important aspect of the present invention, recess 73 has interior dimensions corresponding to those of fin slot 35. In further accordance with an important aspect of the present invention, ribs 74 and 75 of recess 73 in socket cover plate 36 interlock with ridges 70 and 71 respectively of slot walls 55 and 54 respectively to form an interlocking junction providing a continuous extension of surface between recess 73 and fin slot 35.

It should be noted that while FIG. 3 sets forth an exploded view of the assembly of socket cover plate 36 to socket base 51 and the assembly thereof into recess 26 in foam core 25, it has been found preferable to preassemble socket cover plate 36 and socket base 51 to form fin socket 30 and thereafter assembly fin socket 30 within recess 26 in foam core 25. It should be apparent to those skilled in the art that while it has been found advantageous to assemble fin socket 30 from a combination of two individually molded parts through the foregoing described adhesive assembly process, fin socket 30 may, if desired, be assembled as a single unit without departing from the spirit and scope of the present invention.

Figure 4:
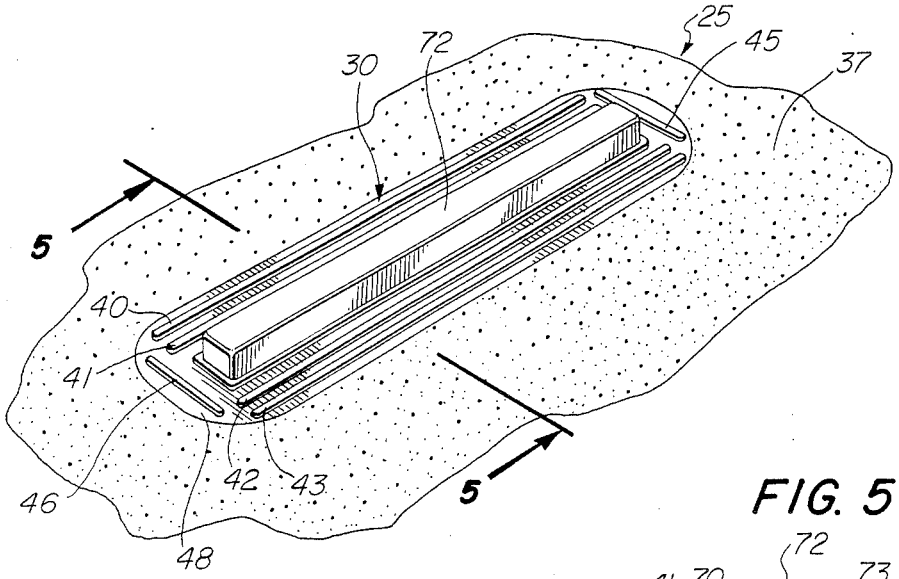
FIG. 4 is a perspective view of the present invention fin mounting socket secured within the contoured recess of FIG. 3.

With socket cover plate 36 and socket base 51 assembled in accordance with the foregoing operation, the resulting fin socket 30 is assembled within recess 26 by coating recess 26 with a suitable adhesive and pressing fin socket 30 therein until the adhesive is cured. The resulting assembly at this point is shown in FIG. 4 in which fin socket 30 is secured within recess 26 of foam core 25 such that upper surface 48 of socket cover plate 36 is flush with surface 37 of foam core 25. When so secured, it should be noted that in accordance with an important aspect of the present invention, ribs 40 through 43 as well as ribs 45 and 46 extend upwardly from surface 48 and rise above surface 37 of foam core 25. In addition, it should also be noted that slot cover 72 extends above surface 37 and ribs 40 through 43 and ribs 45 and 46. At the point of assembly depicted in FIG. 4, surfboard 10 is ready to receive the foregoing described fiberglass laminations which complete the surfboard assembly.

Figure 5:
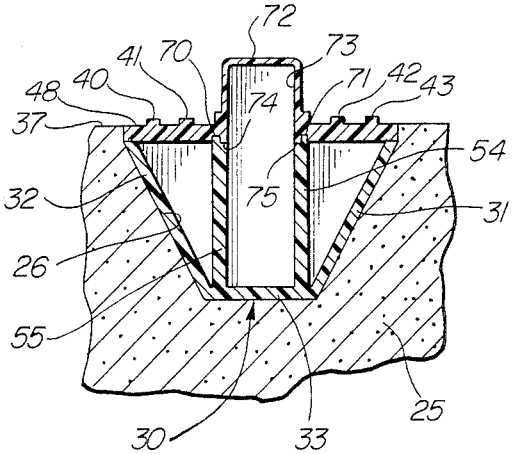
FIG. 5 is a section view of the fin socket of FIG. 4 taken along section lines 5—5 of FIG. 4

FIG. 5 sets forth a section view of fin socket 30 secured within recess 26 as shown in FIG. 4 and taken along section lines 5—5 therein. As can be seen in FIG. 5, fin socket 30 is secured within recess 26 such that sides 31 and 32 as well as bottom surface 33 of fin socket 30 are adhesively secured to the surfaces of recess 26. It should also be noted that in accordance with the foregoing, surface 48 of socket cover plate 36 is substantially flush with surface 37 of foam core 25. It should also be noted that, in accordance with the foregoing, the combination of slot walls 54 and 55 and the junction of ridges 70 and 71 to ribs 74 and 75 respectively together with the interior of recess 73 form a continuous substantially straight-walled cavity appropriately sized to receive fin base 24 (the latter shown in FIG. 2). It should also be noted that slot cover 72, which terminates the upper portion of recess 73, closes the resulting fin slot cavity thus formed at this point in the manufacturing process. While it has been found advantageous to utilize recess 73 with closed slot cover 72 as shown to protect the interior of fin slot 35 during the laminating process and thus avoid undesired deposits of laminating resins therein, it will be apparent to those skilled in the art that recess 73 may alternatively be fabricated without the closure of fin slot cover 72 provided recess 73 extends upwardly from surface 48 a substantial distance and care is taken in the laminating process.

Figure 6:
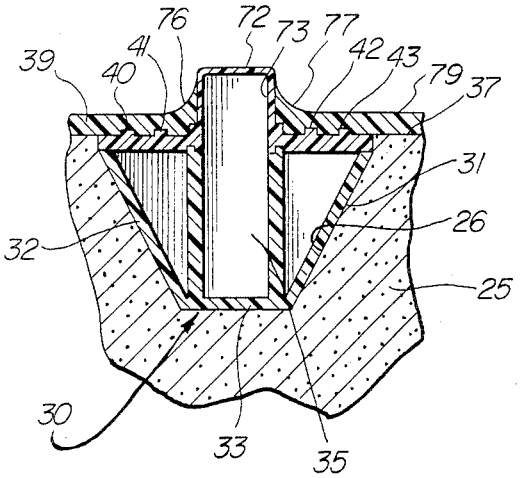
FIG. 6 is a section view of the fin socket of FIG. 5 after the laminating process has been completed.

FIG. 6 sets forth the cross section view of FIG. 5 in which fin socket 30 resides within recess 26 and one or more layers of fiberglass laminations 39 have been applied to surface 37 of surfboard 10 in accordance with the foregoing described laminating process. In accordance with an important aspect of the present invention, it should be noted that fiberglass laminations 39 and the saturating resins therein extend continuously from surface 37 across surface 48 and incapsulate ribs 40, 41, 42 and 43 together with the exterior surfaces of recess 73. In accordance with the preferred fabricated method, fiberglass laminations 39 are carried forward such that a substantial excess of laminating resin 76 and 77 accumulate along the exterior surfaces of recess 73. It will be apparent from examination of FIG. 6 that an important function of slot cover 72 is to avoid the unwanted deposit of resin material within fin slot 35. It will be equally apparent that in the absence of slot cover 72, the dimensions of recess 73 should be increased upwardly by a substantial distance to permit the deposit of excess materials 76 and 77 along the sides of recess 73. In either event, it will be apparent to those skilled in the art by examining FIG. 6 that the laminating operation of surfboard 10 may be carried forward without undue care and concern for the presence of fin socket 30 within the rear portion of the surfboard. It should be mentioned at this point that while the structure and details of mounting fin 20 within fin socket 30 have been shown in detail, identical constructions are utilized in mounting fins 21 and 22 and that it is anticipated that all three fin sockets would be in place prior to the laminating process. As can be seen, the laminating process may be carried forward with the same ease as if no fins were to be attached to the surfboard. This is in accordance with a very important aspect of the present invention in that the foregoing described process involves substantial extra time in the prior methods of fabrication to work around the fin structures during the laminating process and in laminating the fins to the surfboard laminations.

Once the resin within fiberglass laminations 39 has completely cured, the surface of surfboard 10 may be sanded in accordance with the general surfboard fabrication techniques described above. Additionally, the portions of excess resin 76 and 77 as well as the portion of recess 73 and slot cover 72 extending above the upper surface 79 of laminations 39 are sanded flat to produce a smooth continuous surface and the structure shown in FIG. 7.

Figure 7:
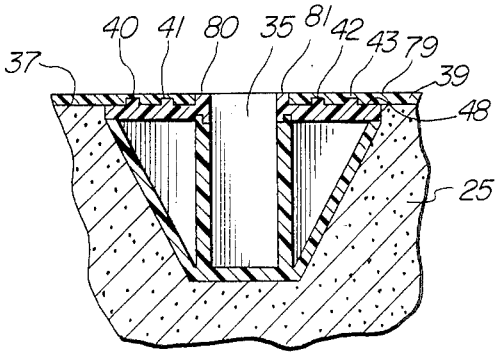
FIG. 7 is a section view of the socket shown in FIG. 6 after the excess slot cover has been sanded away during the finishing process.

FIG. 7 sets forth the completed structure of the present invention fin mount prior to the insertion of fin base 24 of fin 20 within fin slot 85. As can be seen in FIG. 7, the foregoing described sanding operation has produced a continuous fiberglass lamination layer 89 which is reduced in thickness from that shown in FIG. 6 but which nonetheless remains securely bonded to surface 37 of foam core 25 and surface 48 of socket cover plate 36. In addition, lamination 39 continues to incapsulate ribs 40 through 43 in accordance with the foregoing. With the sanding of the excess portions of recess 73 and lamination 39 and the removal thereby of slot cover 72, fin slot 35 terminates at its upper extreme in a pair of upwardly extending wall portions 80 and 81 which previously formed part of recess 73 and which now form the upper surrounding edge of fin slot 35. In accordance with an important aspect of the present invention, the strength of lamination 39 together with the adhesive bonding of fin socket 30 within recess 26 provide considerable mounting strength for fin socket 30 and securely retain it within foam core 25.

The final assembly step is carried forward with the adhesive assembly of fin 20 to slot 35 by inserting fin base 24 therein with an appropriate deposit of adhesive material. It will be apparent to those skilled in the art that the resulting structure provides substantial improvements in ease of manufacture and strength of fin mounting without imposing any undue weight upon the surfboard.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in permanently securing a surfboard fin having a base portion to a surfboard wherein the surfboard defines a bottom surface and an elongated recess having a side surface and a top surface at the desired location of the surfboard fin, a surfboard fin socket comprising:

an elongated housing defining an upper surface, a side surface joined thereto, said upper and said surfaces being configured to be received within the elongated recess of the surfboard;

an outwardly extending flange forming a portion of a lower surface of said housing; and an elongated internal cavity within said housing extending above said flange and configured to receive the base portion of the surfboard fin in an adhesive bonding attachment.

2. A surfboard fin socket as set forth in claim 1 wherein said flange is positioned with respect to said bottom surface such that said flange is substantially flush with said surfboard surface.

3. A surfboard fin socket as set forth in claim 2 wherein said upper surface of said housing is substantially planar and wherein said side surface defines a continuous inclined wall surface joined to said upper surface and forming an outwardly extending surface configured to be received within said elongated recess of said surfboard and terminating in a lower edge.

4. A surfboard fin socket as set forth in claim 3 wherein said flange extends to and is joined to said lower edge of said inclined side wall.

5. A surfboard fin socket as set forth in claim 4 wherein said flange defines an exterior surface and a plurality of raised ribs thereon.

6. A surfboard fin socket as set forth in claim 5 wherein said elongated internal cavity includes an extension and a cover forming a closure of said cavity.

7. For use in securing a surfboard fin to a surfboard fabricated by laminating a plurality of laminations, a shaped core wherein the surfboard core defines a bottom surface and an elongated recess at the desired location of the surfboard fin, the combination comprising:

a surfboard fin defining a fin member and a mounting base having a continuous outer surface;

a socket housing configured to be received within said elongated recess of said surfboard core prior to the lamination of said core, said socket defining an extending cavity configured to receive said mounting base of said surfboard fin in a permanent adhesive attachment to said outer surface.

8. The combination set forth in claim 7 wherein said laminations of said surfboard are applied to said core after said socket housing is assembled within said elongated recess such that said laminations extend over a portion of said socket housing and wherein said extending cavity extends beyond said laminations.

9. The combinations set forth in claim 8 wherein said extending cavity includes a closed portion which is removed after said lamination are in place.

10. A method of mounting a surfboard fin to a surfboard fabricated by laminating a shaped core wherein the surfboard core defines a bottom surface comprising the steps of:

cutting a contoured recess within the surfboard core at the desired location of the fin;

adhesively securing a surfboard fin socket within said contoured recess, said socket defining an internal extending elongated cavity extending beyond said bottom surface;

applying one or more lamination layers of fiberglass and fiberglass resin to said surfboard core such that said socket is secured beneath the laminations with the extending elongated cavity extending above the lamination surface;

removing a portion of the extending elongated cavity and a portion of the surrounding lamination material such that the elongated cavity is substantially flush with the surface of the lamination material; and assembling a fin member by adhesive assembly within the elongated cavity of the fin mounting socket.

* * * * *